US007185619B2

(12) United States Patent
Motohashi

(10) Patent No.: US 7,185,619 B2
(45) Date of Patent: Mar. 6, 2007

(54) ROCKER ARM AND METHOD OF MANUFACTURING THE SAME

(75) Inventor: Nobutsuna Motohashi, Katsuragi (JP)

(73) Assignee: Koyo Seiko Co., Ltd., Osaka (JP)

( * ) Notice: Subject to any disclaimer, the term of this patent is extended or adjusted under 35 U.S.C. 154(b) by 65 days.

(21) Appl. No.: 11/033,470

(22) Filed: Jan. 12, 2005

(65) Prior Publication Data

US 2005/0166879 A1 Aug. 4, 2005

(30) Foreign Application Priority Data

Jan. 13, 2004 (JP) ..... P2004-005383

(51) Int. Cl.
*F01L 1/18* (2006.01)

(52) U.S. Cl. ..... 123/90.44; 123/90.51; 123/90.39; 74/559; 74/569; 29/888.2; 148/DIG. 3; 148/229; 148/233; 148/663

(58) Field of Classification Search ..... 123/90.44
See application file for complete search history.

(56) References Cited

U.S. PATENT DOCUMENTS

| | | | | |
|---|---|---|---|---|
| 4,856,469 A | | 8/1989 | Okazaki et al. | |
| 4,904,094 A | * | 2/1990 | Furumura et al. | 384/492 |
| 5,268,040 A | * | 12/1993 | Naito et al. | 148/233 |
| 5,336,338 A | * | 8/1994 | Toda | 148/319 |
| 5,413,643 A | * | 5/1995 | Murakami et al. | 148/319 |
| 6,158,263 A | * | 12/2000 | Maeda et al. | 72/237 |
| 6,197,128 B1 | * | 3/2001 | Maeda | 148/319 |
| 6,478,893 B1 | * | 11/2002 | Takemura | 148/320 |
| 6,808,571 B2 | * | 10/2004 | Tanaka et al. | 148/663 |

FOREIGN PATENT DOCUMENTS

| | | |
|---|---|---|
| JP | 55-087809 | 7/1980 |
| JP | 59-013046 | 1/1984 |
| JP | 60-125349 | 7/1985 |
| JP | 01-066407 | 3/1989 |
| JP | 06-042537 | 2/1994 |
| JP | 6-74004 | 3/1994 |
| JP | 06-129433 | 5/1994 |
| JP | 06-129434 | 5/1994 |
| JP | 07-054616 | 2/1995 |

* cited by examiner

*Primary Examiner*—Thomas Denion
*Assistant Examiner*—Kyle M. Riddle
(74) *Attorney, Agent, or Firm*—McGinn IP Law Group, PLLC

(57) ABSTRACT

A rocker arm 1 made of sheet metal is formed so that Vickers hardness $H_v$ of the surface layer portion 9*a* of the valve stem receiver 9 is set at $H_v$ 650 to 800 and a quantity of the retained austenite γR is set at 25 to 35 vol %.

20 Claims, 3 Drawing Sheets

ROCKER ARM AND METHOD OF MANUFACTURING THE SAME

BACKGROUND OF THE INVENTION

The present invention relates to a rocker arm made of sheet metal used for a valve gear of an automobile engine, and a method of manufacturing the rocker arm.

A rocker arm made of sheet metal provided in a valve gear of an automobile engine is formed in such a manner that a roller is arranged between a pair of opposed side walls provided in a body made of sheet metal and this roller is pivotally supported by a spindle via needle rollers. Connecting walls are formed so as to respectively connect the opposed side walls to each other and are arranged in the longitudinal direction. One of the connecting walls is used as a lash adjuster receiver and the other connecting wall is used as a valve stem receiver.

In this rocker arm made of sheet metal, when a cam is contacted with the roller and rolled on it and the body is oscillated round the lash adjuster which functions as a fulcrum, and the valve stem is moved upward and downward by the valve stem receiver, the valve can be opened and closed. Concerning this structure, for example, refer to Patent Document 1.

Patent Document 1: JP-A-6-74004

A lubricating state on the sliding contact face of the valve stem receiver of the rocker arm made of sheet metal, on which the valve stem slides and contacts, is not so good, so that abnormal abrasion and pitching tend to occur on the sliding contact face. As a countermeasure for preventing the occurrence of the abnormal abrasion and pitching, generally, a crowning is formed on the sliding contact face of the valve stem receiver or surface pressure of the contact with the valve stem is reduced.

However, when the viscosity of engine oil used as lubricant is decreased, the lubricating state of the sliding contact face of the valve stem becomes more severe, and the above countermeasure for preventing the occurrence of abnormal abrasion and pitching is not sufficient.

SUMMARY OF THE INVENTION

In view of above, an object of the present invention is to provide a rocker arm in which the occurrence of abnormal abrasion and pitching on the sliding contact face of the valve stem receiver is effectively prevented or suppressed, and method of manufacturing the rocker arm.

The present invention provides a rocker arm made of sheet metal of low carbon steel characterized in that: Vickers hardness of a surface layer portion of at least a sliding contact face of a valve stem is set at $H_v$ 650 to 800 by the treatment of carburizing, quenching and tempering; and a quantity of retained austenite is set at γR25 to 35 vol %. It is preferable that the carbon content of the above low carbon steel is not more than 0.4 wt %.

In general, when a quantity of retained austenite γR is large, the hardness of steel tends to be lowered. However, when the valve stem slides on the valve stem receiver, a portion of the retained austenite in the surface layer portion of the valve stem is transformed into martensite, the hardness of which is increased to be higher than Vickers hardness $H_v$ 650 to 800.

Accordingly, the fatigue resistance property and the rolling fatigue resistance property of the sliding contact face of the valve stem are enhanced as compared with those of the conventional case. Therefore, it is possible to effectively prevent the occurrence of abnormal abrasion and pitching on the sliding contact face of the valve stem.

This valve stem receiver is formed by utilizing one of the connecting walls formed on both sides of a pair of the opposed side walls in the longitudinal direction. The connecting wall composing the valve stem receiver may be formed in such a manner that after the connecting wall has been formed separately from a pair of the opposed side walls, it is integrated between both the opposed side walls into one body by means of welding. Alternatively, the connecting wall composing the valve stem receiver may be formed in such a manner that when a blank member is formed out of one metallic sheet, a region that will become the connecting wall is integrally formed.

In any case, since Vickers hardness of the surface layer portion on the sliding contact face of the valve stem receiver is set at $H_v$ 650 to 800 and a quantity of the retained austenite γR is set at 25 to 35 vol %, the quenching temperature in the process of carburizing, quenching and tempering is set at a value higher than that of the conventional case so that a quantity of the retained austenite to be transformed to martensite can be reduced, and when the tempering temperature is set at a value lower than that of the conventional case, decomposition of the retained austenite γR is suppressed so that a quantity of the retained austenite γR can be set at 25 to 35 vol %.

It is preferable that a large number of dimples are formed on the sliding contact face of the valve stem receiver, because it becomes possible to hold lubricant in the dimples. Therefore, it is possible to supply lubricant such as engine oil to the sliding contact face according to the sliding motion conducted between the valve stem and the sliding contact face of the valve stem receiver. When the sliding contact face concerned is sufficiently lubricated in this way, it becomes possible to effectively suppress the occurrence of abnormal abrasion and pitching on the sliding contact face.

It is preferable that the above dimples are formed by means of shot peening. Shot peening treatment is a cold working in which small hard balls of small diameters are accelerated and jetted out by a projection device so that the small hard balls can collide with the sliding contact face. By this shot peening treatment, the surface to be treated is made somewhat rough and the surface is hardened by work and given a high compressive residual stress.

In the case where the dimples are formed by means of shot peening as described above, the sliding contact face of the valve stem receiver is hardened by work. Therefore, it is possible to more effectively prevent the occurrence of abnormal abrasion and pitching on the sliding contact face of the valve stem receiver.

Accordingly, it is possible to effectively prevent or suppress the occurrence of abnormal abrasion and pitching on the sliding contact face of the valve stem receiver.

DETAILED DESCRIPTION OF PREFERRED EMBODIMENTS

Figure 1:
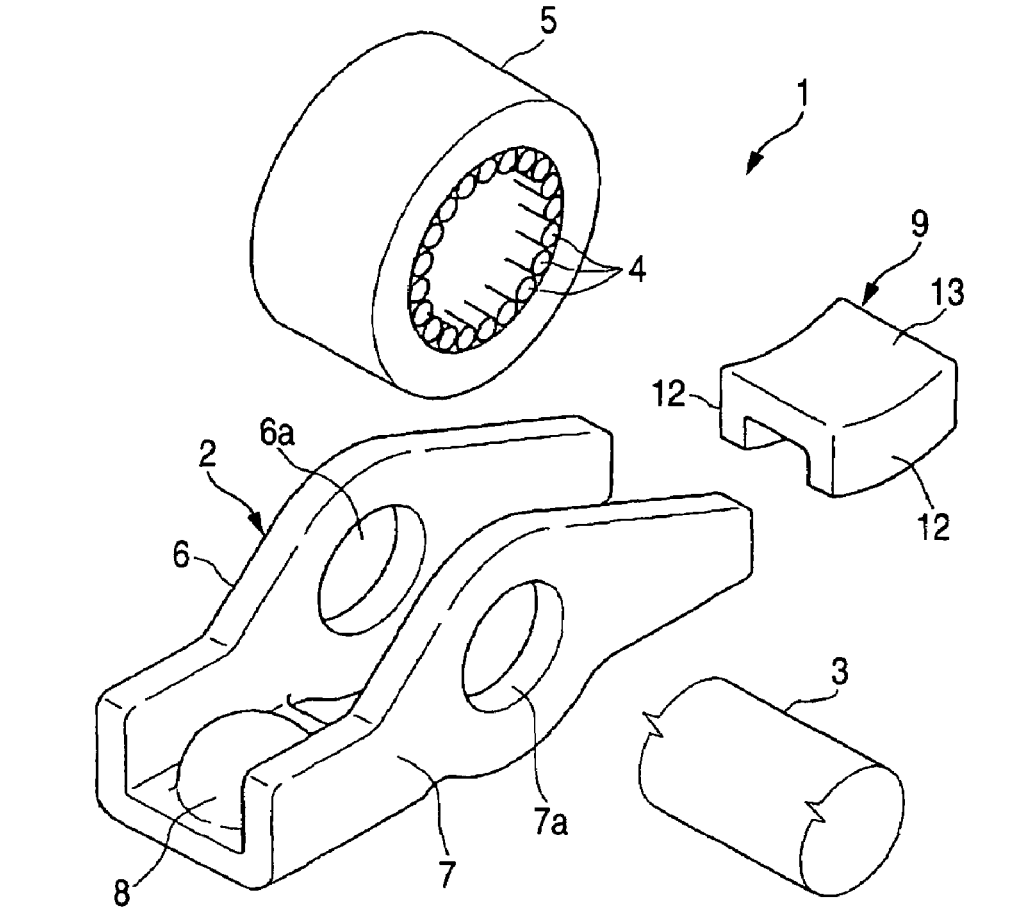
FIG. 1 is a perspective view of the rocker arm made of sheet metal according to the preferred embodiment of the present invention.
Figure 2:
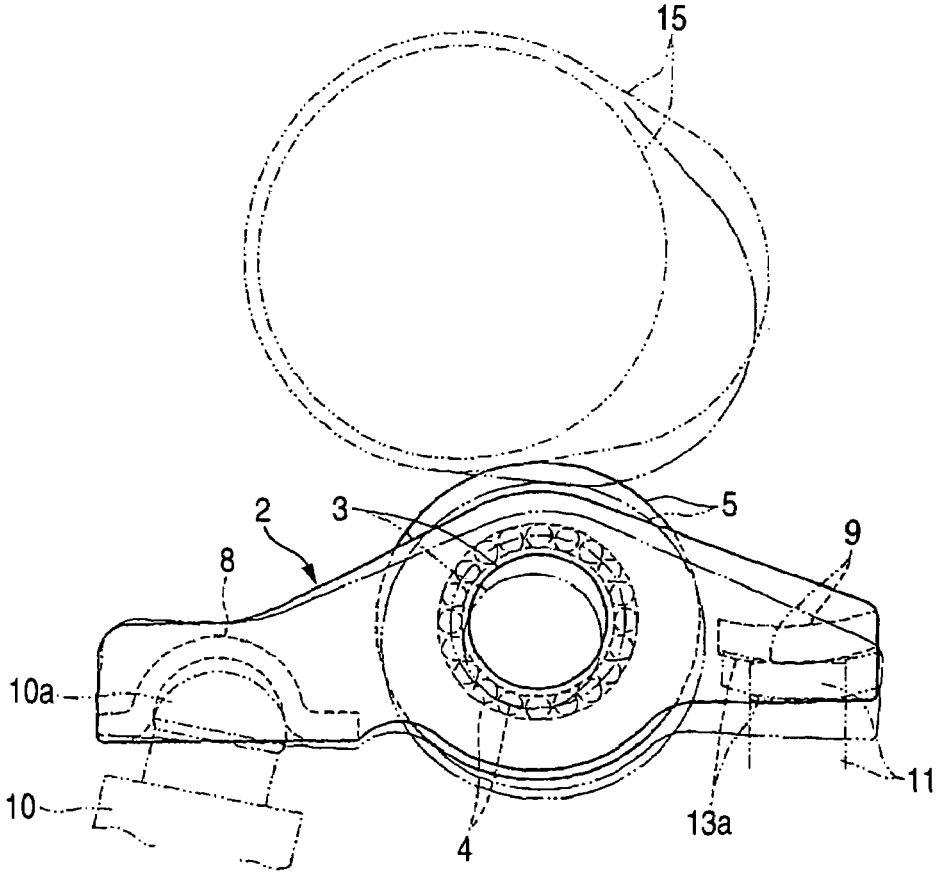
FIG. 2 is a side view showing an overall state of the use of the rocker arm.
Figure 3:
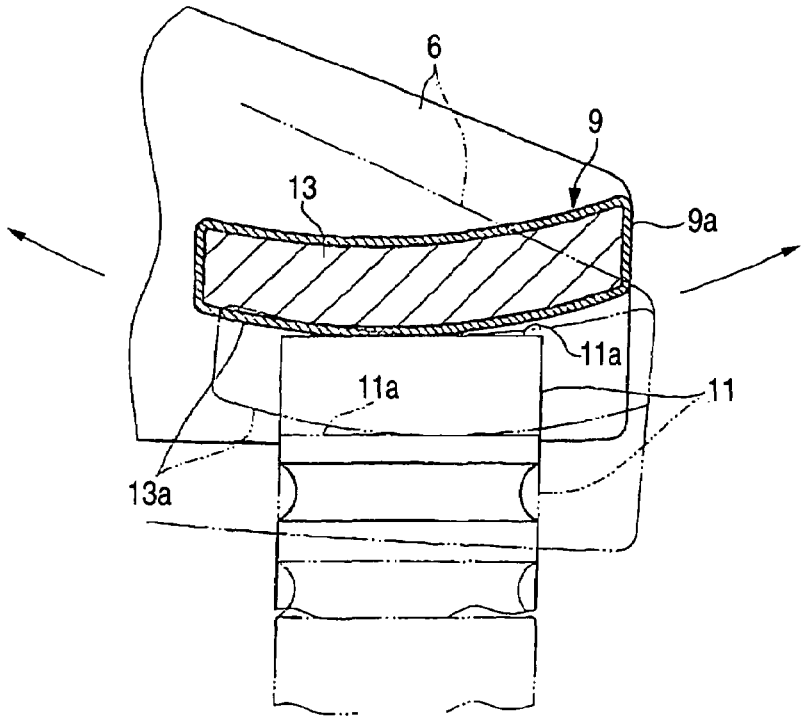
FIG. 3 is an enlarged sectional view showing a state of sliding of the valve stem receiver of the rocker arm and the valve stem.
Figure 4:
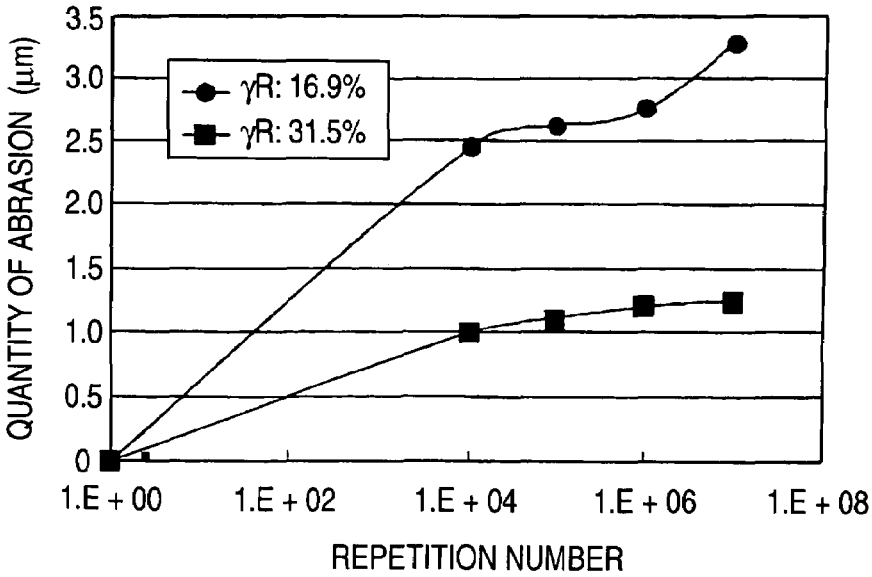
FIG. 4 is a graph showing a relation between the repetition number and the quantity of abrasion.

Referring to the accompanying drawings, the embodiment according to the present invention will be described below. FIG. 1 is an exploded perspective view showing an overall arrangement of a rocker arm, FIG. 2 is a sectional view of the rocker arm viewed at the center in the width direction, FIG. 3 is an enlarged sectional view showing a state of contact of the connecting wall of the rocker arm with a valve stem, and FIG. 4 is a graph showing a relation between the repetition number and the quantity of abrasion.

Referring to these views, reference numeral 1 defines a rocker arm made of sheet metal. The rocker arm is provided with a body 2. The body 2 includes a pair of opposed side walls 6, 7. The opposed side walls 6, 7 respectively include the spindle holes 6*a*, 7*a* for supporting the spindle 3 in the respective central region in the longitudinal direction. The spindle 3 is nonrotatably assembled to the opposed side walls 6, 7 by press fitting end portions of the spindle 3 to the opposed side walls 6, 7 to pressure contact with the circumferential wall faces of the spindle holes 6*a*, 7*a*.

The roller 5 is externally pivotally attached to the spindle 3 via the needle rollers 4. The rocker arm 1 includes: a connecting wall 8 to connect both the opposed side walls 6, 7 on one side in the longitudinal direction of the opposed side walls 6, 7; and a connecting wall 9 to connect both the opposed side walls 6, 7 on the other side in the longitudinal direction of the opposed side walls 6, 7.

The connecting wall 8 on one side constitutes a lash adjuster receiver 8 into which an upper end portion of the lash adjuster 10 is inserted, and the connecting wall 9 on the other side constitutes the valve stem receiver 9 to receive an upper end portion of the valve stem 11. The valve stem receiver 9 is formed separately from the opposed side walls 6, 7 and fixed between the opposed side walls 6, 7 by welding.

The valve stem receiver 9 is formed in such a manner that a rectangular flat plate is formed into a shape, the cross section of which is substantially a C-shape. The valve stem receiver 9 includes a roof wall portion 13 to connect the hanging wall portions 12, 12, which are provided on opposite sides, to each other. The lower face of the roof wall portion 13 constitutes a valve stem sliding contact face 13*a* on which the upper end face 11*a* of the valve stem 11 comes into contact and slides. This valve stem sliding contact face 13*a* is expanded downward and formed into a crowning shape which curves in the longitudinal direction.

In this rocker arm 1, in response to the motion in which the cam 15 comes into contact with the outer circumferential face of the roller 5 and rotates, the roller 5 is rotated around the spindle 3 via the needle rollers 4, and the roller 5 is pushed in accordance with the rotation of the cam 15. Therefore, the body 2 of the rocker arm 1 is oscillated round the sliding portion between the upper end portion 10*a* of the lash adjuster 10 and the lash adjuster receiver 8. According to this oscillating motion of the body 2, the valve stem 11 is moved upward and downward so that the valve can be opened and closed.

The rocker arm 1 formed and operated as described above is made of low carbon steel, and the valve stem receiver 9 is also made of low carbon steel. It is preferable that the carbon content of this low carbon steel is not more than 0.4 wt %. Examples of the low carbon steel, the carbon content of which is not more than 0.4 wt %, are SCM415, SCM420, SCR420 and so forth stipulated by JIS.

Vickers hardness $H_v$ of the surface layer portion 9*a* including the valve stem sliding contact face 13*a* is set at $H_v$ 650 to 800, and a quantity of the retained austenite γR is set at 25 to 35 vol %.

Concerning the above points, in the case of the conventional rocker arm, low carbon steel is subjected to carburizing, quenching and tempering so that Vickers hardness $H_v$ of the surface layer portion is set at $H_v$ 650 to 800, and a quantity of the retained austenite γR is set at 14 vol %. In this conventional rocker arm, even when the valve stem sliding contact face is formed into a shape of crowning, there is a possibility that abnormal abrasion and pitching occur on the valve stem sliding contact face.

In the case of the rocker arm 1 of the present invention, before the low carbon steel is subjected to carburizing, quenching and tempering, the valve stem receiver 9 is previously welded to the opposed side walls 6, 7. Then, the heat treatment condition with respect to the rocker arm 1 is changed to adjust Vickers hardness of the surface layer portion of the valve stem sliding contact face 13*a* to $H_v$ 650 to 800 and adjust a quantity of the retained austenite γR to be 25 to 35 vol %.

In this case, the heat treatment condition is changed in such a manner that the quenching temperature of the body 2 is set at a value higher than that of the conventional case and the tempering temperature of the body 2 is set at a value lower than that of the conventional case. When the quenching temperature of the body 2 is set at a higher value as described above, a quantity of the retained austenite to be transformed into martensite can be reduced. When the tempering temperature of the body 2 is set at a lower value as described above, the decomposition of the retained austenite is suppressed so that a quantity of the retained austenite γR can be adjusted to be 25 to 35 vol %.

In this connection, in general, when a quantity of the retained austenite γR is large, the hardness tends to decrease. However, according to the sliding motion of the valve stem 11 on the valve stem sliding contact face 13*a*, the retained austenite of 25 to 35 vol % is decomposed and transformed into martensite, so that the hardness of the surface layer portion of the valve stem sliding contact face 13*a* can be further raised.

Although it is conventional that a quantity of the retained austenite γR of the valve stem receiver 9 is approximately 14%, according to the present invention, the quantity of the retained austenite γR of the valve stem receiver 9 is set at 25 to 35 vol %, and the quantity of the retained austenite γR of the valve stem receiver 9 is preferably set at 28 to 32 vol %. Therefore, life of the valve stem receiver 9 is prolonged. Further, when the retained austenite is decomposed, the hardness of the surface layer portion of the valve stem sliding contact face 13*a* is raised and it becomes difficult for the valve stem sliding contact face 13*a* to be plastically deformed. Accordingly, it is possible to enhance the impact resistance property, the fatigue resistance property, the abrasion resistance property and the pitching resistance property of the valve stem sliding contact face 13*a*.

The above facts have been proved by the experiments lade by the inventors. In FIG. 4, black circles "●" represent a conventional case in which a quantity of the retained austenite γR is 16.9 vol %, and black square "■" represent a case of the present invention in which a quantity of the retained austenite γR is 31.5 vol %. When the above two cases are compared with each other, the following can be definitely said. Concerning "the repetition number" corresponding to the sliding number of the sliding motions conducted between the valve stem sliding contact face 13*a* and the valve stem 11, "a quantity of abrasion" of the valve stem sliding contact face 13*a* of the case of the present invention is remarkably smaller than that of the conventional case.

As described above, when the contact surface pressure given between the valve stem sliding contact face 13*a* and the valve stern 11 is reduced by forming the valve stem sliding face 13*a* into a crowning shape and a quantity of the retained austenite γR of the valve stem sliding contact face 13*a* is increased as compared with that of the conventional case, the fatigue resistance property of the valve stem sliding contact face 13*a* can be enhanced and the occurrence of abnormal abrasion and pitching can be effectively prevented.

What is claimed is:

1. A rocker arm comprising:

a valve stem receiver comprising sheet metal of low carbon steel, said valve stem receiver including a sliding contact face, wherein a valve stem slides and contacts said valve stem receiver, wherein Vickers hardness of a surface layer portion of said sliding contact face comprises a range of Hv 650 to 800, and a quantity of retained austenite of the surface layer portion of said sliding contact face comprises a range of γR 25 to 35 vol %.

2. The rocker arm according to claim 1, wherein the quantity of retained austenite of the surface layer portion comprises a range of γR 28 to 32 vol %.

3. The rocker arm of claim 1, wherein said sliding contact face of said valve stem receiver comprises dimples formed thereon for holding lubricant.

4. The rocker arm of claim 1, wherein said sheet metal of low carbon steel comprises a carbon content of no greater than 0.4%.

5. The rocker arm of claim 1, wherein said sliding contact face of said valve stem receiver comprises a convex crown shape.

6. A method of manufacturing a rocker arm comprising sheet metal of low carbon steel, the method comprising:

performing treatment of carburizing, quenching and tempering with respect to a valve stem receiver of the rocker arm such that Vickers hardness of a surface layer portion of a sliding contact face of the valve stem receiver comprises a range of Hv 650 to 800, and a quantity of retained austenite of the surface layer portion of said sliding contact face comprises a range of γR 25 to 35 vol %.

7. The method of manufacturing a rocker arm according to claim 6, wherein said performing said treatment of quenching sets a quenching temperature at a higher value than a predetermined quenching temperature such that said quantity of said retained austenite to be transformed into martensite is reduced.

8. The method of manufacturing a rocker arm according to claim 6, wherein performing said treatment of tempering sets a tempering temperature at a value lower than a predetermined tempering temperature such that decomposition of said retained austenite is suppressed such that a quantity of the retained austenite comprises a range of γR 25 to 35 vol %.

9. The method of manufacturing a rocker arm according to claim 6, further comprising:

shot peening said surface layer portion of said sliding contact face of said valve stem receiver to form dimples thereon for holding lubricant.

10. The method of manufacturing a rocker arm according to claim 6, wherein said sheet metal of low carbon steel comprises a carbon content of no greater than 0.4%.

11. The method of manufacturing a rocker arm according to claim 6, further comprising:

forming said sliding contact face of said valve stem receiver into a convex crown shape.

12. A method of manufacturing a rocker arm comprising sheet metal of low carbon steel, the method comprising:

welding a valve stem receiver to said rocker arm; and performing treatment of carburizing, quenching and tempering to adjust Vickers hardness of a surface layer portion of a sliding contact face of said valve stem receiver to comprise a range of $H_v$ 650 to 800, and to adjust a quantity of the retained austenite of the surface layer portion of said valve stem receiver to a range of γR 25 to 35 vol %.

13. The method of manufacturing a rocker arm according to claim 12, wherein said performing said treatment of quenching sets a quenching temperature at a higher value than a predetermined quenching temperature such that said quantity of said retained austenite to be transformed into martensite is reduced.

14. The method of manufacturing a rocker arm according to claim 12, wherein said performing said treatment of tempering sets a tempering temperature at a value lower than a predetermined tempering temperature such that decomposition of said retained austenite is suppressed such that a quantity of the retained austenite comprises a range of γR 25 to 35 vol %.

15. The method of manufacturing a rocker arm according to claim 12, further comprising:

shot peening said surface layer portion of said sliding contact face of said valve stem receiver to form dimples thereon for holding lubricant.

16. The method of manufacturing a rocker arm according to claim 12, wherein said sheet metal of low carbon steel comprises a carbon content of no greater than 0.4%.

17. The method of manufacturing a rocker arm according to claim 12, further comprising:

forming said sliding contact face of said valve stem receiver into a convex crown shape.

18. The method of manufacturing a rocker arm according to claim 12, wherein the quantity of retained austenite of the surface layer portion comprises a range of γR 28 to 32 vol %.

19. The method of manufacturing a rocker arm according to claim 14, wherein the quantity of retained austenite of the surface layer portion comprises a range of γR 28 to 32 vol %.

20. The method of manufacturing a rocker arm according to claim 12, wherein said sheet metal of low carbon steel comprises a carbon content of no greater than 0.4%.

* * * * *